US010584293B2

(12) United States Patent
Foerg

(10) Patent No.: US 10,584,293 B2
(45) Date of Patent: Mar. 10, 2020

(54) FUEL ADDITIVE

(71) Applicant: ECOMANDA AG, Zug (CH)

(72) Inventor: Wolfgang Foerg, Zug (CH)

(73) Assignee: ECOMANDA AG, Zug (CH)

( * ) Notice: Subject to any disclaimer, the term of this patent is extended or adjusted under 35 U.S.C. 154(b) by 0 days.

(21) Appl. No.: 16/060,024

(22) PCT Filed: May 10, 2016

(86) PCT No.: PCT/EP2016/060462
§ 371 (c)(1),
(2) Date: Jun. 7, 2018

(87) PCT Pub. No.: WO2017/121497
PCT Pub. Date: Jul. 20, 2017

(65) Prior Publication Data

US 2018/0371344 A1 Dec. 27, 2018

(30) Foreign Application Priority Data

Jan. 13, 2016 (EP) ..... 16000060

(51) Int. Cl.

| | |
|---|---|
| ***C10L 1/182*** | (2006.01) |
| ***C10L 1/18*** | (2006.01) |
| ***C10L 1/222*** | (2006.01) |
| ***C10L 1/12*** | (2006.01) |
| ***C10L 10/02*** | (2006.01) |
| ***C10L 1/16*** | (2006.01) |
| ***C10L 1/10*** | (2006.01) |
| *C10L 1/188* | (2006.01) |

(52) U.S. Cl.
CPC ..... *C10L 1/1824* (2013.01); *C10L 1/10* (2013.01); *C10L 1/125* (2013.01); *C10L 1/1616* (2013.01); *C10L 1/1802* (2013.01); *C10L 1/2227* (2013.01); *C10L 10/02* (2013.01); *C10L 1/1881* (2013.01); *C10L 2200/0423* (2013.01); *C10L 2200/0446* (2013.01)

(58) Field of Classification Search
CPC combination set(s) only.
See application file for complete search history.

(56) References Cited

U.S. PATENT DOCUMENTS

| | | | | |
|---|---|---|---|---|
| 3,822,119 | A | 7/1974 | Frech et al. | |
| 4,099,930 | A | 7/1978 | Webb | |
| 4,992,187 | A | 2/1991 | Adams et al. | |
| 2002/0155585 | A1* | 10/2002 | Tanaka | C10G 32/00 435/281 |
| 2003/0170513 | A1* | 9/2003 | Varadaraj | C10L 1/328 429/424 |
| 2004/0200137 | A1 | 10/2004 | Bongardt et al. | |
| 2009/0035192 | A1* | 2/2009 | Hwang | B01D 53/90 422/170 |
| 2013/0118058 | A1* | 5/2013 | Nguyen | C10L 1/1802 44/302 |

FOREIGN PATENT DOCUMENTS

| | | | |
|---|---|---|---|
| CN | 101490220 | A | 7/2009 |
| EP | 0117915 | A2 | 9/1984 |
| GB | 950147 | A | 2/1964 |
| JP | H07278576 | A | 10/1995 |
| RU | 2147602 | C1 | 4/2000 |

OTHER PUBLICATIONS

International Search Report of PCT Patent Application No. PCT/EP2016/060462 dated Aug. 17, 2016.

Sheng-Lun Lin et al., Energy Savings and Emission Reduction of Nitrogen Oxides, Particulate Matter, and Polycyclic Aromatic Hydrocarbons by Adding Water-Containing Acetone and Neat Soybean Oil to a Diesel-Fueled Engine Generator, Energy & Fuels, Aug. 19, 2010, pp. 4522-4533, vol. 24, No. 8.

* cited by examiner

*Primary Examiner* — Ellen M McAvoy
*Assistant Examiner* — Chantel L Graham

(57) ABSTRACT

The invention pertains to a novel additive for fuels comprising iso-propanol in an amount of from 60-70 Vol.-%, diesel and gasoline each in an amount of from 10-20 vol.-% and water in an amount of from 1-5 vol.-%. In another aspect the composition comprises Iso-propanol in an amount of from 60-70 vol.-%, lineseed oil in an amount of from 15-25 vol.-%, gasoline fuel in an amount of from 10-20 vol.-%, and water in an amount of from 1-5 vol.-%. The invention further relates to the use of the said additive in reducing carbon monoxide (CO) and unburnt hydrocarbons (HC) levels from emissions of combustion engines.

33 Claims, No Drawings

FUEL ADDITIVE

FIELD OF THE INVENTION

The present invention pertains to a novel additive or admixture for fuels to be burnt in combustion engines, comprising Isopropanol, diesel and gasoline, and water. In particular the present additive comprises isopropanol in an amount of from 60-70 Vol.-%, diesel and gasoline each in an amount of from 10-20 vol.-% and water in an amount of from 1-3 vol.-%. In another aspect the additive comprises iso-propanol in an amount of from 60-70 vol.-%, lineseed oil in an amount of from 15-25 vol.-%, gasoline fuel in an amount of from 10-20 vol.-%, and water in an amount of from 1-5 vol.-%. The invention further relates to the use of the said additive in reducing toxic emission gases from combustion engines, in particular carbon monoxide (CO) and unburnt hydrocarbons (HC).

BACKGROUND ART

Most of the private mobility nowadays takes place via using a vehicle propelled by an internal combustion engine wherein largely two types of fuels are burnt for driving the vehicle, diesel or gasoline/petrol.

The burning/combustion process of diesel/gasoline involves oxidation of hydrocarbons contained in the diesel/gasoline with oxygen to eventually yield $CO_2$ and $H_2O$. Yet, combustion processes are always inadequate, so that the fuel is only incompletely oxidized, which incomplete combustion process yields toxic substances, such as carbon monoxide (CO) and lower hydrocarbons (HC).

Carbon monoxide is a well known contaminant irreversibly blocking an individual's capability of breathing. Hence, higher concentrations of carbon monoxide in the breathing air will eventually lead to the individual's death. Yet, also lower doses of CO are detrimental to the individual's health by creating depression and heart damage.

Lately it has been found that unburnt hydrocarbons (HC), such as produced by burning fossil fuels in power plants, house heatings, vehicles and in various industrial processes account at least in part of a phenomenon widely known as "respirable particulate matter" or "fine dust", which terms designate particulate matter smaller than about 10 μm or even smaller than 2.5 μm.

Due to its size such respirable particulate matter may stay in the air for a week or more before settling to the ground by gravitation. Since its production goes along with activities of mankind, the highest levels is found in agglomerates, that is larger cities. In case dislodgement of the particular matter is not effected by wind taking it away to the countryside, it accumulates in the cities' air, even capable of rendering the environment in a haze.

Respirable particulate matter has been recognized as a major threat to human health. The WHO consider airborne particulates a strong carcinogen, since these small particulates have the ability to penetrate into the individuals blood streams unfiltered by the lung or nose barrier, causing permanent DNA mutations, heart attacks, and premature death. A recent study carried out in Europe in 2013 involving about 325.000 people indicated that one the one hand there is no safe level of particulates while on the other hand for each increase of 10 $\mu g/m^3$ in respirable particulate matter of 10 μm and smaller the lung cancer rate rose by about 20%. Even more, smaller matter with a diameter of less than 2.5 μg was shown to be particularly lethal, increasing the incident of lung cancer by 36% per 10 $\mu g/m^3$ increase.

In cities the traffic is considered to be a major cause for the production of respirable particulate matter.

In order to reduce toxic emissions from combustion engines the engines have undergone a development for improving utilization of the fuel fed into them while at the same time increasing oxidation efficiency. Further, catalysts have been built in vehicles to further reduce the amount of contaminants contained in the emissions.

Yet, also the fuel composition was the focus for further research to improve its combustion and reducing the production of toxic substances.

GB 950147 A discloses a fuel composition fur improving energy yield containing as the major component hydrocarbons having an octane No. of at least 90 and an octane number-improving amount of an organic-metal-containing anti-knock agent, as well as up to 2 vol.-% by co-anti-knock agents and extenders. As such additives among others isopropanol and water are mentioned.

U.S. Pat. No. 4,099,930 relates to an energy-saving fuel additive for gasoline and diesel engines which comprises a mixture of picric acid and ferrous sulphate in a solvent of alkyl benzene, isopropyl alcohol, and water. The additive may be injected directly into the combustion engine or added by bulk addition to the fuel container.

JP 7278576 discloses a method of reducing emission of toxic substances from combustion engines by providing an additive for complementing fuel, the additive comprising alcohol(s), such as an ethyl alcohol mixing agent, n-propyl alcohol, iso-propyl alcohol, n-butanol or iso-butanol. Depending on the water content of the alcohol(s) an emulsifier may be used.

Further U.S. Pat. No. 4,992,187 discusses a composition for cleaning combustion engines comprising a composition of selected cyclic compounds, such as N-methyl-2-pyrrolidone, aliphatic amines, such as n-butylamine and water, which are dissolved in hydrocarbons and aliphatic lower alcohols, such as isopropanol.

However, due to the rapidly increasing number of vehicles all around the world there is still an unmet demand to further reduce the amount of toxic emissions from combustion engines.

SUMMARY OF THE INVENTION

The present invention addresses this problem and provides a composition to be added to a fuel, which upon burning the fuel reduces the amount of carbon monoxide (CO) and unburnt hydrocarbons (HC) in exhaust gases.

The present composition according to a first aspect comprises isopropanol in an amount of from 60-70 vol.-%, diesel and gasoline each in an amount of from 10-20 vol.-% each, and water in an amount of from 1-5 vol.-%.

According to another aspect of the invention the composition comprises isopropanol in an amount of from 60-70 vol.-%, lineseed oil in an amount of from 15 to 25 vol.-%, gasoline in an amount of from 10 to 20 vol.-% and water in an amount of from 1 to 5 vol.-%. According to an embodiment the lineseed oil may be present in a mixture with diesel in an amount of up to 20 vol.-% diesel.

According to a preferred embodiment the amount of isopropanol resides in the range of from 61-70 vol.-%, more preferably of from 62-70 vol.-%, even more preferred of from 63-70 vol.-%, yet more preferred from 64-70 vol.-% or from 65-70 vol.-%, or even from 66-70 vol.-%, or from 67-70% or from 68-70 vol.-%.

The fuel component, i.e. the diesel and the gasoline are each independently present in an amount of from 10-20 vol.-%. Preferably the diesel and gasoline are each independently present in an amount of from 11-20 vol.-%, more preferably from 12-20 vol.-%, or from 13-20 vol.-%, or from 14-20 vol.-%, or from 15-20 vol.-% or from 16-20 vol.- or from 17-20 vol.-% or from 18-20 vol.-% or from 19-20 vol.-%.

The lineseed oil may be of natural or technical origin. Preferably, the amount of lineseed oil is between 16 vol.-% and 24 vol.-%, more preferably between 17 vol.-% and 23 vol.-%, even more preferred between 18 vol.-% and 22 vol.-%, most preferably between 19 volö.% and 21 vol.-%. In this case the gasoline amount is preferred to be between 10 vol.-% and 16 vol.-%, more preferably between 11 vol.-% and 15 vol.-% and even more preferred between 12 vol.-% and 14 vol.-% and the water amount is between 1 and 3 vol.-%. A preferred composition comprises 65 vol.-% isopropanol, 20 vol.-% technical lineseed oil, 13 vol.-% petrol and 2 vol.-% water.

The diesel to be used in the fuel component may be any diesel available, such as Diesel fulfilling the requirement according to DIN 51601, diesel having a lower cetan number, such as that available in the US, GtL diesel, water diesel as well as marine distillate fuel.

As the gasoline any petrol, gas or fuel of ROZ 91, ROZ 95, ROZ 98 or even ROZ 100 may be used as well as gasoline to which additives like ethanol, sold as gasoline E10 in the EU, MTBE or ETBE had been added.

In a yet preferred embodiment the composition comprises between 1 and 5‰, preferably between 2-4‰ by weight of urea or carbamide to increase complete conversion of nitrogen oxides to ammonia and water. The urea is most preferable between 2.5 and 3.5 by weight ‰ and in liquid form such as commercially available in, but not limited to AdBlue®.

It will be acknowledged by the skilled person that the above fuel described above comprises any of the seasonal derivatives available.

Water is contained in the composition in an amount of between 1 vol.-% and 5 vol.-% and in between, preferably between 1 vol.-% and 3 vol.-%. The water is preferably deionized.

In order to obtain the present composition the four components are mixed such that a homogeneous mixture is obtained, which stays stable for prolonged period of time without separation of the individual components. Methods and apparatuses for obtaining a homogeneous mixture are well known in the art and include e.g. rotor-stator-systems, stream mechanic systems or ultra sound generators. In an embodiment the mixture may be stabilized by using emulgators known in the art.

The composition of the present invention is added to a conventional fuel to be burnt in combustion engines, such as to a diesel, i.e. any diesel as described above, gasoline, such as any petrol as described above or to fuel used in house heatings, respectively, AvGasoline, MoGasoline, kerosene in aeroplanes or even heating oil in house heatings or even power plants. Specifically in applications, in which there is no catalyst, as in automotives, the present invention is particularly valuable.

The composition may be added to the fuel in a ratio of from 1:8000-1:12.000, preferably 1:9000-1:11,000, more preferably 1:9.500-1:10.500, more preferred 10.000.

The following examples illustrate the invention without limiting it thereto.

EXAMPLE I

An AUDI Q7, 4.2 l, petrol engine, built in 2013 and equipped with a catalyst, fulfilling the EU exhaust gases requirements was subjected to a drive cycle EPA US 06. The drive length was 12 km.

The car has been filled with conventional gasoline, ROZ 95 and subjected to the test while determining the amount of CO and HC, which is set to 100% as reference.

Prior to starting an experiment with a fuel, the car was depleted from the previous fuel, refueled with the new fuel and run for 15 minutes at idle speed with the respective new fuel to warm the motor and fill all lines and the engine with the respective fuel to be tested.

Experiments have been carried out with additives according to the invention (embodiments 1-3, 6-8) and with additives, wherein the amount of individual components are not within the limits indicated or where a fuel component was replaced by another component (embodiments 4-5).

The respective compositions have been added to fuel in a ratio of roughly 1:10.000 prior to filling the car.

The exhaust gases were analyzed for C and HC and the amount of CO and HC determined with the fuel+additive was indicated in percentage reduction as compared to the reference.

Additives:

| | | | | |
|---|---|---|---|---|
| 1. | M 1 Isoprop. = 65%, | D = 17%, | B = 16% | W = 2%. |
| 2. | M 2 Isoprop. = 65%, | D = 17%, | B = 15%, | W = 3%. |
| 3. | M 3 Isoprop. = 70%, | D = 14%, | B = 14% | W = 2%. |
| 4. | M 4 Isoprop. = 55%, | D = 20%, | B = 22%, | W = 3%. |
| 5. | M 5 Isoprop. = 65%, | D = 15%, | B = 15%, | W = 5%. |
| 6. | M 6 Isoprop. = 65%, | techn. lineseed oil = 20%, | B = 12%, | W = 3%. |
| 7. | M 7 Isoprop. = 65%, | techn. lineseed oil = 20%, | B = 10%, | W = 5% |
| 8. | M 8 Isoprop. = 65%, | techn. lineseed oil = 17%, | B = 16%, | W = 2%. |

Isoprop. = isopropanol;
D = diesel;
B = gasoline;
W water.

The following results have been obtained:

| | | | | |
|---|---|---|---|---|
| 1. | CO | −39%, | HC | −28%. |
| 2. | CO | −37%, | HC | −27%. |
| 3. | CO | −32%, | HC | −24%. |
| 4. | CO | −18%, | HC | −15%. |
| 5. | CO | −29%, | HC | −21%. |
| 6. | CO | −38%, | HC | −28%. |
| 7. | CO | −33%, | HC | −25%. |
| 8. | CO | −39%, | HC | −28%. |

As may be seen, all compositions produced an decreased level of CO. However, in case the amount of isopropanol exceeds the lower level of 60 vol.-% or the amount of water exceeds the upper limit of 3 vol.-% the amount of HC is increased. Good results are also achieved when replacing diesel with technical lineseed oil.

EXAMPLE II

A similar experiment has been carried out with a Hyundai i30, built in 2010, diesel engine, and equipped with a catalyst, fulfilling the EU exhaust gases requirements was subjected to a drive cycle. The drive length as 11 km. The following additive has been prepared:

| | |
|---|---|
| Isopropanol | 660 ml |
| Diesel | 160 ml |
| Benzin | 160 ml |
| Water | 20 ml |
| Urea | 3 ml |

The additive has been added to the diesel fuel in a ratio of 1:10.000.

Exhaust gases have been determined according to 70/220/EWG i.d.F. 98/69/B/EG.

The following results have been obtained as compared to the reference (diesel without additive);

| | City | Countryside |
|---|---|---|
| CO | −73% | −16% |
| HC | −45% | −31%. |

The invention claimed is:

1. A composition comprising
iso-propanol in an amount of from 60-70 vol.-%,
diesel fuel in an amount of from 10-20 vol.-%,
gasoline fuel in an amount of from 10-20 vol.-%, and
water in an amount of from 1-5 vol.-%.

2. A composition comprising
iso-propanol in an amount of from 60-70 vol.-%,
lineseed oil in an amount of from 15-25 vol.-%,
gasoline fuel in an amount of from 10-20 vol.-%, and
water in an amount of from 1-5 vol.-%.

3. The composition of claim 1, wherein the amount of iso-propanol is in the range of from 65-70 vol.-%.

4. The composition of claim 1, wherein the amount of diesel and/or gasoline is in a range of from 13-17 vol.-% each.

5. The composition of claim 2, wherein the amount of lineseed oil is between 18 vol.-% and 22 vol. %.

6. The composition of claim 1, wherein the amount of water is between 1.5 and 3 vol. %.

7. The composition according to claim 2, wherein the lineseed oil is present in admixture with diesel.

8. The composition according to claim 1, wherein urea is provided in an amount of between 1 and 5%.

9. A fuel comprising the composition according to claim 1.

10. The fuel according to claim 9, wherein the fuel is selected from diesel, gasoline, AvGasoline, MoGasoline, kerosene, or heating oil.

11. A method for preparing fuel, providing lower CO and HC emissions, comprising the step of adding the composition according to claim 1 to the fuel in a ratio of 1:8,000-to 1:12,000.

12. The method of claim 11, wherein the composition is added to the fuel in an amount of 1:10,000.

13. A method for reducing carbon monoxide and hydrocarbons levels in exhaust gases of combustion engines, comprising the step of adding the composition according to claim 1 to a fuel in a ratio of 1:8,000 to 1:12,000.

14. The method according to claim 13, wherein the amount of carbon dioxide in exhaust gases is reduced by at least 15% and/or wherein the amount of hydrocarbons in exhaust gases is reduced by at least 30%.

15. The fuel according to claim 9, wherein the composition is contained in a ratio of from 1:8,000 to 1:12,000, preferably 1:10,000.

16. The fuel according to claim 9, wherein the fuel is selected from diesel or gasoline, AvGasoline, MoGasoline, kerosene, or heating oil.

17. The composition of claim 2, wherein the amount of iso-propanol is in the range of from 65-70 vol.-%.

18. The composition of claim 2, wherein the amount of diesel and/or gasoline is in a range of from 13-17 vol.-% each.

19. The composition of claim 2, wherein the amount of water is between 1.5 and 3 vol. %.

20. The composition according to claim 2, wherein urea is provided in an amount of between 1 and 5%.

21. The composition of claim 5, wherein the amount of lineseed oil is between 19 and 21 vol.-%.

22. The composition of claim 6, wherein the amount of water is between 2 vol.-% and 3 vol.-%.

23. The composition according to claim 8, wherein urea is provided in an amount of between 2 and 4% by weight and most preferred between 2.5 and 3.5% of weight.

24. The composition according to claim 8, wherein urea is provided in an amount of between 2.5 and 3.5% of weight.

25. The fuel according to claim 15, wherein the composition is contained in a ratio of 1:10,000.

26. The composition of claim 19, wherein the amount of water is between 2 vol.-% and 3 vol.-%.

27. The composition according to claim 20, wherein urea is provided in an amount of between 2 and 4% by weight.

28. The composition according to claim 20, wherein urea is provided in an amount of between 2.5 and 3.5% of weight.

29. A fuel comprising the composition according to claim 2.

30. The fuel according to claim 29, wherein the composition is contained in a ratio of from 1:8,000 to 1:12,000.

31. A method for preparing fuel, providing lower CO and HC emissions, comprising the step of adding the composition according to claim 2 to the fuel in a ratio of 1:8,000- to 1:12,000.

32. The method of claim 31, wherein the composition is added to the fuel in an amount of 1:10,000.

33. A method for reducing carbon monoxide and hydrocarbons levels in exhaust gases of combustion engines, comprising the step of adding the composition according to claim 2 to a fuel in a ratio of 1:8,000 to 1:12,000.

* * * * *